US007820307B2

(12) United States Patent
Kurihara et al.

(10) Patent No.: US 7,820,307 B2
(45) Date of Patent: Oct. 26, 2010

(54) RECORDING PAPER

(75) Inventors: Eizo Kurihara, Ebina (JP); Tsukasa Matsuda, Ebina (JP); Mario Fuse, Ashigarakami-gun (JP); Shoji Yamaguchi, Ashigarakami-gun (JP); Kunihiro Takahashi, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/040,313

(22) Filed: Feb. 29, 2008

(65) Prior Publication Data

US 2009/0017334 A1 Jan. 15, 2009

(30) Foreign Application Priority Data

Jul. 10, 2007 (JP) ..... 2007-181122

(51) Int. Cl.
*B32B 15/00* (2006.01)

(52) U.S. Cl. ..... 428/692.1

(58) Field of Classification Search ..... 162/138, 162/140; 428/537.5, 800, 836, 692.1, 693.1
See application file for complete search history.

(56) References Cited

U.S. PATENT DOCUMENTS

| | | | | |
|---|---|---|---|---|
| 5,240,561 | A * | 8/1993 | Kaliski | 162/138 |
| 2005/0126730 | A1* | 6/2005 | Lorusso | 162/181.8 |
| 2007/0014973 | A1* | 1/2007 | Koda et al. | 428/195.1 |
| 2007/0146765 | A1 | 6/2007 | Matsuda et al. | |

FOREIGN PATENT DOCUMENTS

| | | | |
|---|---|---|---|
| JP | 52-038904 | A | 3/1977 |
| JP | 55-146500 | U | 10/1980 |
| JP | A-07-032778 | | 2/1995 |
| JP | A-10-143708 | | 5/1998 |
| JP | 2000-284521 | A | 10/2000 |
| JP | 2001-126909 | A | 5/2001 |
| JP | 2003-005421 | A | 1/2003 |
| JP | A-2004-284053 | | 10/2004 |
| JP | A-2004-285524 | | 10/2004 |
| JP | 2007-021884 | A | 2/2007 |
| JP | 2007-164293 | A | 6/2007 |
| JP | 2007-169837 | A | 7/2007 |
| JP | 2007-169842 | A | 7/2007 |
| JP | 2007-177333 | A | 7/2007 |

* cited by examiner

*Primary Examiner*—Holly Rickman
*Assistant Examiner*—Lisa Chau
(74) *Attorney, Agent, or Firm*—Oliff & Berridge, PLC

(57) ABSTRACT

A recording paper having a magnetic material-containing layer, that includes a magnetic material that generates a large Barkhausen effect and a filler, and is disposed between pulp layers containing a pulp.

10 Claims, 5 Drawing Sheets

RECORDING PAPER

CROSS-REFERENCE TO RELATED APPLICATIONS

This application is based on and claims priority under 35 USC 119 from Japanese Patent Application No. 2007-181122, filed Jul. 10, 2007.

BACKGROUND

1. Technical Field

The present relates to a recording paper.

2. Related Art

Preventing counterfeiting is extremely important for special documents such as bank notes and marketable securities.

In recent years, as computers and networks have become more widespread, it has become relatively simple to acquire a desired piece of information from a vast quantity of information, and then print or copy the acquired piece of information. As a result, much attention is being focused on the problem of leaked confidential information, arising from printed items obtained by the illegal copying or printing of highly confidential information. Accordingly, a variety of devices and methods have been proposed for strengthening information security in order to prevent such leaked confidential information arising from printed items obtained by the illegal copying or printing of highly confidential information.

In the above types of special documents and printing papers used for preventing counterfeiting, a metal fiber such as a magnetic material that produces a large Barkhausen effect is blended into or embedded within the paper.

SUMMARY

According to a first aspect of the present invention, there is provided a recording paper having a magnetic material-containing layer, which contains a magnetic material that generates a large Barkhausen effect and a filler, and is disposed between pulp layers containing a pulp.

BRIEF DESCRIPTION OF THE DRAWINGS

Exemplary embodiments of the present invention will be described in detail based on the following figures, wherein.

DETAILED DESCRIPTION

Exemplary embodiments of the present invention are described below. These exemplary embodiments merely represent examples for implementing the present invention, and the present invention is in no way limited by these exemplary embodiments.

Figure 1:
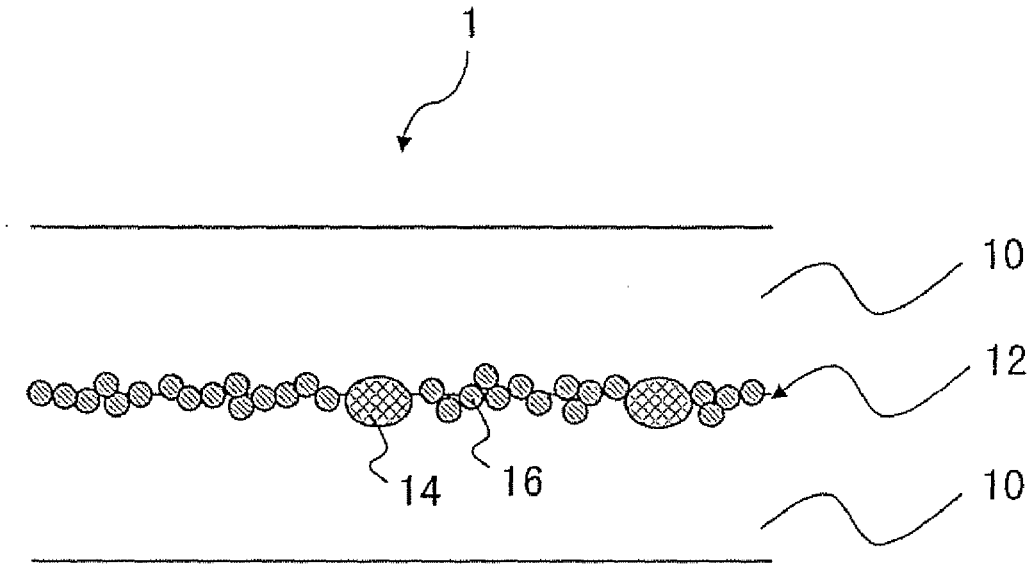
FIG. 1 is a schematic cross-sectional view showing one example of a recording paper according to an exemplary embodiment of the present invention.

FIG. 1 is a schematic cross-sectional view showing one example of the configuration of a recording paper according to an exemplary embodiment of the present invention. The recording paper 1 includes pulp layers 10 and a magnetic material-containing layer 12. As shown in FIG. 1, the magnetic material-containing layer 12, which contains a magnetic material 14 and a filler 16, is formed between two pulp layers 10.

Figure 2:
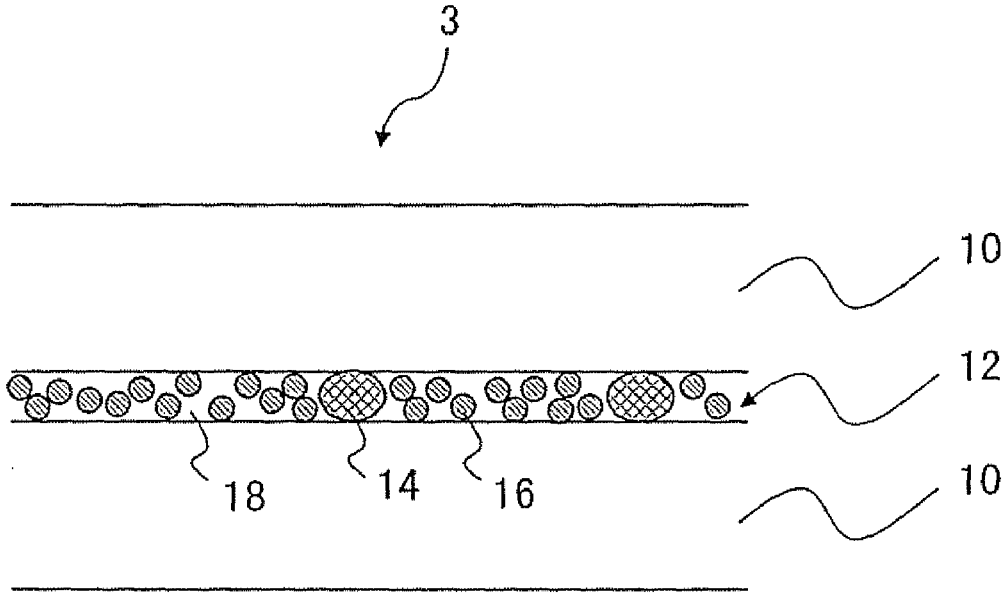
FIG. 2 is a schematic cross-sectional view showing another example of a recording paper according to an exemplary embodiment of the present invention.

Furthermore, FIG. 2 is a schematic cross-sectional view showing another example of the configuration of a recording paper according to an exemplary embodiment of the present invention. The recording paper 3 includes pulp layers 10 and a magnetic material-containing layer 12. As shown in FIG. 2, the magnetic material-containing layer 12, which contains a magnetic material 14, a filler 16 and a pulp 18, is formed between two pulp layers 10.

More detailed descriptions of the structural materials, production methods, and physical properties of the recording papers according to the exemplary embodiments of the present invention are presented below.

<Magnetic Material>

Figure 3A:
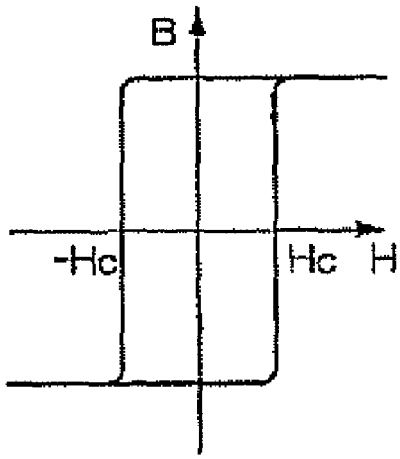
FIGS. 3A, 3B and 3C are diagrams explaining the large Barkhausen effect for a magnetic material.
Figure 3B:
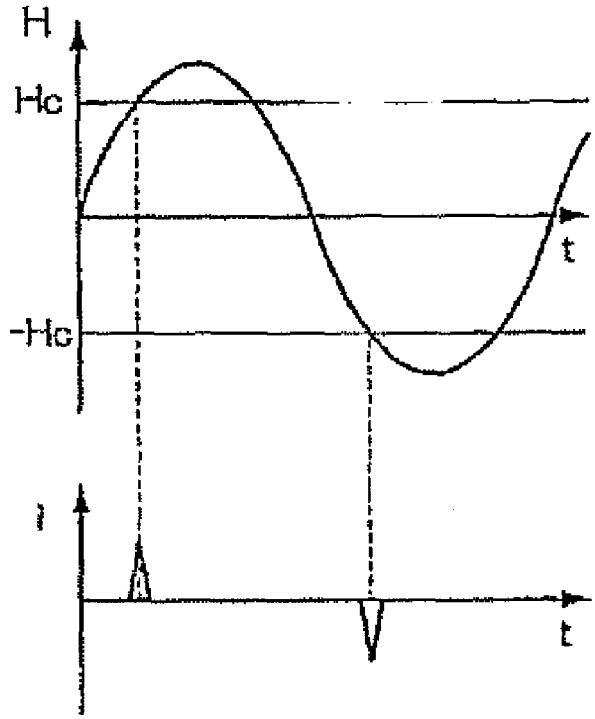
Figure 3C:
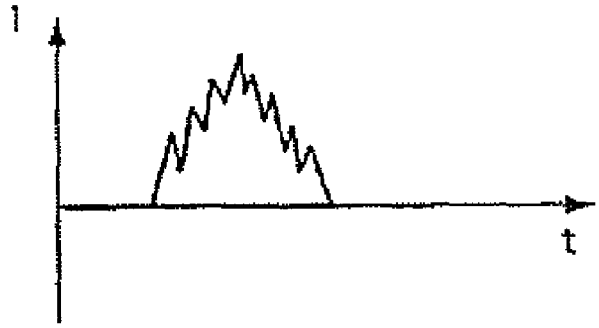

The magnetic material 14 contained within the recording paper according to an exemplary embodiment of the present invention generates a large Barkhausen effect. A simple explanation of the large Barkhausen effect is presented below. FIGS. 3A-3C represent a series of diagrams explaining the large Barkhausen effect. The large Barkhausen effect is a phenomenon in which a dramatic magnetization reversal occurs when a material such as an amorphous magnetic material of Co—Fe—Ni—B—Si having the type of B-H (magnetic flux density-magnetic field) characteristics shown in FIG. 3A, namely a substantially rectangular hysteresis loop and a comparatively small coercive force (Hc), is placed in an alternating magnetic field. Accordingly, if an alternating current is passed through an excitation coil to generate an alternating magnetic field, and a magnetic material is placed within this alternating magnetic field, then upon magnetization reversal, a pulse-like current will flow through a detection coil placed in the vicinity of the magnetic material.

For example, when an alternating magnetic field such as that shown in the upper part of FIG. 3B is generated by the excitation coil, a pulse current such as that shown in the lower part of FIG. 3B flows through the detection coil.

However, the current that flows through the detection coil also includes an alternating current induced by the alternating magnetic field, and the pulse current is detected superimposed on this alternating current. Furthermore, if an item that includes multiple magnetic materials is placed in the alternating magnetic field, then the multiple pulse currents are also superimposed, meaning a current such as that shown in FIG. 3C is detected.

Examples of the magnetic material 14 incorporated within the interior of a recording paper according to an exemplary embodiment include common permanent magnets, including rare earth systems such as materials containing neodymium (Nd)-iron (Fe)-boron (B) as the primary components and materials containing samarium (Nd)-cobalt (Co) as the primary components, alnico systems such as materials containing aluminum (Al)-nickel (Ni)-cobalt (Co) as the primary components, ferrite systems comprising barium (Ba) or strontium (Sr) and iron oxide ($Fe_2O_3$) as the primary components, as well as other soft magnetic materials, oxide soft magnetic materials, and amorphous magnetic materials in which the basic composition is a Fe—Co—Si or Co—FeNi system.

Next is a description of the paper substrate. There are no particular restrictions on the pulp fiber that is used as the principal component of the paper substrate, and examples of pulp fibers include hardwood and/or softwood kraft pulp fiber, sulfite pulp fiber, semichemical pulp fiber, chemiground pulp fiber, ground wood pulp fiber, refiner ground pulp fiber, and thermomechanical pulp fiber. Furthermore, fibers obtained by chemically modifying the cellulose or hemicellulose within the above fibers can also be used if required.

Furthermore, other fibers such as cotton pulp fiber, hemp pulp fiber, kenaf pulp fiber, bagasse pulp fiber, viscose rayon fiber, recycled cellulose fiber, copper-ammonia rayon fiber, cellulose-acetate fiber, polyvinyl chloride-based fiber, polyacrylonitrile-based fiber, polyvinyl alcohol-based fiber, polyvinylidene chloride-based fiber, polyolefin-based fiber, polyurethane-based fiber, polyvinyl chloride, polyvinyl alcohol copolymers, fluorocarbon-based fiber, glass fiber, carbon fiber, alumina fiber, metal fiber, and silicon carbide fiber can also be used, and these fibers may be used either alone, or in a combination containing multiple fibers.

Furthermore, if necessary, the Taber abrasion and internal bonding strength of the fiber may be increased by using a fiber obtained by impregnating or heat-sealing an aforementioned pulp fiber with a synthetic resin such as polyethylene, polypropylene, polystyrene, polyvinyl chloride or polyester.

Furthermore, high-quality or medium-quality recycled paper pulp may also be blended into the pulp fiber described above. The blend quantity of this recycled paper pulp can be determined in accordance with the intended application, purpose or the like, and for example in those cases where recycled paper pulp is added in order to conserve resources, the blend quantity of the recycled paper pulp may be typically approximately 10% by mass or greater, and preferably approximately 30% by mass or greater of the total quantity of pulp fiber.

The pulp 18 that is incorporated within the magnetic material-containing layer 12 as shown in FIG. 2 can use the same pulp fiber as that used for the primary component within the paper substrate described above.

In order to adjust the opacity, whiteness, and surface properties of the paper, a filler may also be added to the paper substrate used for the recording paper according to an exemplary embodiment of the present invention.

There are no particular restrictions on the types of fillers hat may be added to the pulp layer 10 and the magnetic material-containing layer 12 of the recording paper according to an exemplary embodiment, provided that the filler contains organic or inorganic particles typically used as a paper filler, and specific examples include inorganic fillers, including calcium carbonate-based fillers such as heavy calcium carbonate, light calcium carbonate and chalk, silicates such as kaolin, baked clay, pyrophyllite, sericite and talc, as well as titanium dioxide, calcium sulfate, barium sulfate, zinc oxide, zinc sulfide, zinc carbonate, aluminum silicate, calcium silicate, magnesium silicate, synthetic silica, aluminum hydroxide, alumina, white carbon, saponite, dolomite, calcium montmorillonite, sodium montmorillonite, and bentonite; and organic fillers including polymethylmethacrylate particles, acrylic plastic pigments, polyolefin resin particles such as polyethylene, chitosan particles, cellulose particles, polyamino acid particles, and styrene.

Various chemicals such as sizing agents may also be added, either internally or externally, to the paper substrate used in producing the recording paper according to an exemplary embodiment of the present invention. Examples of the types of sizing agents that can be added to the paper substrate include rosin-based sizing agents, synthetic sizing agents, petroleum resin-based sizing agents, and neutral sizing agents. Combinations of a sizing agent such as aluminum sulfate or cationized starch with a fixing agent may also be used.

Of the above sizing agents, for an image forming apparatus that employs an electrophotographic method, the use of a neutral sizing agent such as an alkenyl succinic anhydride sizing agent, alkyl ketene dimer, alkenyl ketene dimer, neutral rosin, petroleum sizing agent, olefinic resin, or styrene-acrylic resin is preferred in terms of the storage stability of the recording paper following image formation. Furthermore, surface-sizing agents such as oxidized starch, enzymatically modified starch, polyvinyl alcohol, cellulose derivatives such as carboxymethyl cellulose, styrene-acrylic latex, styrene-maleic acid latex and acrylic latex can also be used, either alone or in combinations with other sizing agents.

In addition, a paper-strengthening agent may also be added, either internally or externally, to the paper substrate of the recording paper according to an exemplary embodiment.

Examples of the paper-strengthening agent include starch, modified starch, vegetable gum, carboxymethyl cellulose, polyvinyl alcohol, modified polyvinyl alcohol, polyacrylamide, styrene-maleic anhydride copolymers, vinyl chloride-vinyl acetate copolymers, styrene-butadiene copolymers, polyacrylate esters, urea-formaldehyde resin, melamine-formaldehyde resin, dialdehyde starch, polyethyleneimine, epoxidated polyamide, polyamide-epichlorohydrin resin, methylolated polyamide and chitosan derivatives, and these materials maybe used either alone, or in combinations of two or more different materials.

In addition to the materials above, other assistants that are typically added to paper media, such as dyes and pH controllers, may also be used.

The recording paper according to an exemplary embodiment of the present invention can be produced, for example, by sandwiching either a magnetic material-containing layer 12 that contains the magnetic material 14 and the filler 16, or a magnetic material-containing layer 12 that contains the magnetic material 14, the filler 16 and the pulp 18, between multiple sheets of a paper substrate prepared by mixing the above primary materials of the paper substrate with any other materials and then conducting papermaking, subsequently bonding the layers together, and then applying a coating of a size press liquid or forming a pigment coating layer as required. Furthermore, the recording paper may also be produced by mixing the above primary materials of the paper substrate, any other materials that constitute the paper substrate, and the magnetic material described above, subjecting the mixture to papermaking or multilayer papermaking, and then applying a coating of a size press liquid or forming a pigment coating layer as required.

There are no particular restrictions on the papermaking method. Multilayer papermaking methods, Fourdrinier papermaking machines, cylinder papermaking machines or twin wire papermaking systems may all be used. Either acidic or neutral papermaking methods may be used.

Examples of multilayer papermaking methods include methods that employ cylinder papermaking, Fourdrinier papermaking, Fourdrinier-cylinder combination papermaking, multihead box papermaking, or tanmo-Fourdrinier papermaking systems. For example, any of the methods described in detail in "The Latest Papermaking Technology—Theory and Practice" authored by Saburo Ishiguro (Seishi-Kagaku Kenkyujo, 1984) may be used; as may a cylinder papermaking system that employs a series of stacked cylinders.

In terms of factors such as improving the surface strength, a sizing agent such as a rosin-based sizing agent, synthetic sizing agent, petroleum resin-based sizing agent, or neutral sizing agent may be added to the surface of the paper substrate (or to the surface of the outermost paper substrate in those cases where the recording paper includes multiple paper substrates), in a quantity that does not impede the absorption of water-based liquids. Combinations of a sizing agent and an inter-fiber fixing agent, such as aluminum sulfate or cationized starch, may also be used.

A size press liquid such as those listed below may be applied to the surface of the paper substrate (or to the surface of the outermost paper substrate in those cases where the recording paper includes multiple paper substrates).

The binder used in the size press liquid maybe an unprocessed starch such as corn starch, potato starch or tapioca starch, or a processed starch such as an enzymatically modified starch, phosphate-esterified starch, cationized starch, or acetylated starch. Furthermore, other water-soluble polymers such as polyethylene oxide, polyacrylamide, sodium polyacrylate, sodium alginate, hydroxymethyl cellulose, carboxymethyl cellulose, methyl cellulose, polyvinyl alcohol, guar gum, casein, curdlan, or derivatives thereof may also be used, either alone or as mixtures, although the present invention is not limited to the compounds listed above. From the viewpoint of production costs, lower-cost starch is often used.

Furthermore, a resistance controller may also be added to the recording paper according to an exemplary embodiment, and examples of the resistance controller include inorganic materials such as sodium chloride, potassium chloride, calcium chloride, sodium sulfate, zinc oxide, titanium dioxide, tin oxide, aluminum oxide and magnesium oxide, and organic materials such as salts of alkyl phosphate esters, salts of alkyl sulfate esters, sodium sulfonate salts, and quaternary ammonium salts, which may be used either alone or as mixtures. A suitable method of incorporating the resistance controller into the recording paper involves adding the inorganic or organic material to the size press liquid described above, and then applying the resulting liquid to the surface of the paper substrate.

Examples of methods for applying the size press liquid to the surface of the paper substrate (or to the surface of the outermost paper substrate in those cases where the recording paper includes multiple paper substrates) include using a size press, or a commonly used coating device such as a shim size, gate roll, roll coater, bar coater, air-knife coater, rod-blade coater or blade coater.

A coating liquid containing mainly an adhesive and a pigment may also be applied to at least one surface of the recording paper according to an exemplary embodiment, thereby forming a pigment coating layer that enables the recording paper to be used as a coated paper.

Furthermore, a resin layer may also be provided on top of the pigment coating layer. There are no particular restrictions on the resin used for the resin layer, and conventional thermoplastic resins maybe used. Examples of these resins include resins containing ester bondings; polyurethane resins; polyamide resins such as urea resins; polysulfone resins; polyvinyl chloride resins; polyvinylidene chloride resins; vinyl chloride-vinyl acetate copolymer resins; vinyl chloride-vinyl propionate copolymer resins; polyol resins such as polyvinyl butyral; cellulose resins such as ethyl cellulose resins and cellulose acetate resins; polycaprolactone resins; styrene-maleic anhydride resins; polyacrylonitrile resins; polyether resins; epoxy resins; phenolic resins; polyolefin resins such as polyethylene resins and polypropylene resins; copolymer resins of an olefin such as ethylene or propylene, and another vinyl monomer; and acrylic resins.

The adhesive incorporated within the coating liquid used for forming the pigment coating layer (hereafter referred to as the pigment layer coating liquid) employs a water-soluble and/or water-dispersible polymer compound, examples of which include starches such as cationic starch, amphoteric starch, oxidized starch, enzymatically modified starch, thermochemically modified starch, esterified starch and etherified starch, cellulose derivatives such as carboxymethyl cellulose and hydroxyethyl cellulose, natural or semi-synthetic polymer compounds such as gelatin, casein, soybean protein and natural rubber, polyvinyl alcohol, polydienes such as isoprene, neoprene and polybutadiene, polyalkenes such as polybutene, polyisobutylene, polypropylene and polyethylene, vinyl-based polymers and copolymers such as vinyl halides, vinyl acetate, styrene, (meth)acrylic acid, (meth) acrylate esters, (meth)acrylamide and methyl vinyl ether, synthetic rubber latexes such as styrene-butadiene systems or methyl methacrylate-butadiene systems, and other synthetic polymer compounds such as polyurethane resins, polyester resins, polyamide resins, olefin-maleic anhydride resins and melamine resins. Either one, or two or more of these polymer compounds may be selected appropriately and used in accordance with the intended quality of the recording paper.

Examples of the pigment incorporated within the pigment layer coating liquid include mineral pigments such as heavy calcium carbonate, light calcium carbonate, kaolin, calcined kaolin, structural kaolin, delaminated kaolin, talc, calcium sulfate, barium sulfate, titanium dioxide, zinc oxide, alumina, magnesium carbonate, magnesium oxide, silica, magnesium aluminosilicate, fine particulate calcium silicate, fine particulate magnesium carbonate, fine particulate light calcium carbonate, white carbon, bentonite, zeolite, sericite and smectite; and organic pigments such as polystyrene resins, styrene-acrylic copolymer resins, urea resins, melamine resins, acrylic resins, vinylidene chloride resins, benzoguanamine resins, and fine hollow particles or through-hole type particles thereof. Either a single pigment, or a mixture of two or more different pigments may be used.

The blend ratio of the adhesive relative to the pigment in the above pigment layer coating liquid is preferably within a range from approximately 5 parts by mass or greater to not more than approximately 50 parts by mass, per approximately 100 parts by mass of the pigment. If the blend ratio of the adhesive relative to approximately 100 parts by mass of the pigment is less than approximately 5 parts by mass, then a problem may arise in that when the pigment layer coating liquid is applied to the paper substrate to form a pigment coating layer on the paper substrate, and an aforementioned resin layer is then applied, the surface of the paper substrate may be affected by the resin solution, making it impossible to obtain a favorable level of white paper gloss. In contrast, if the blend ratio of the adhesive relative to approximately 100 parts by mass of the pigment exceeds approximately 50 parts by mass, then foaming may occur during application of the pigment layer coating liquid to the paper substrate, causing roughness on the surface of the pigment coating layer, and making it impossible to obtain a favorable level of white paper gloss.

The pigment layer coating liquid may also contain various other additives as necessary, including surfactants, pH controllers, viscosity controllers, softening agents, gloss-imparting agents, dispersants, fluidity regulators, conductance inhibitors, stabilizers, antistatic agents, crosslinking agents, antioxidants, sizing agents, fluorescent brighteners, colorants, UV absorbers, defoaming agents, waterproofing agents, plasticizers, lubricants, preservatives and fragrances.

The quantity of the pigment layer coating liquid applied to the aforementioned paper may be determined in accordance with the intended use of the recording paper according to the exemplary embodiment, although typically, a sufficient quantity of the coating liquid is applied to yield a dry mass that is not less than approximately 2 $g/m^2$ and not more than approximately 8 $g/m^2$.

The method used for applying the above pigment layer coating liquid to the surface of the paper substrate that has already been coated with the aforementioned size press liquid may employ conventional coating devices such as a blade coater, air-knife coater, roll coater, reverse roll coater, bar coater, curtain coater, die coater, gravure coater, champlex coater, brush coater, two-roll or metering blade-type size press coater, bill blade coater, short dwell coater, or gate roll coater.

The pigment coating layer provided on the paper substrate forms the surface layer on either one side or both sides of the paper, and this surface layer may also have a multilayer structure formed by providing a single intermediate layer, or if required two or more intermediate layers. In those cases where pigment coating layers are provided on both surfaces of the paper, or where the surface layer has a multilayer structure, the quantities of the coating liquids used for forming each layer, and the nature and quantity of the materials contained within each coating liquid need not necessarily be the same, and these factors may be adjusted appropriately in accordance with the desired quality level, provided the ranges specified above are satisfied.

In those cases where the pigment coating layer is provided on only one surface of the paper, a synthetic resin layer, a coating layer that includes an adhesive and a pigment, or an antistatic layer or the like may be provided on the other surface of the paper in order to prevent curling, improve the printability, and improve the paper feed and discharge characteristics or the like.

Improving the suitability of the paper for various applications may, of course, also be achieved by subjecting the other surface of the paper to any of various post-processing treatments such as treatments for improving factors such as the adhesiveness, magnetism, flame retardancy, heat resistance, water resistance, oil resistance, or slip prevention.

Following optional application of the sizing agent, the size press liquid and the pigment layer coating liquid and the like, the recording paper according to an exemplary embodiment of the invention is preferably subjected to a smoothing treatment using a smoothing treatment device such as a super calender, gloss calender or soft calender. Furthermore, the smoothing may be conducted either on-machine or off-machine, and the configuration of the compression device, the number of compression nips, and the degree of heating may be appropriately adjusted in the same manner as for conventional smoothing devices.

In the recording paper according to an exemplary embodiment, the shape factor of the filler within the magnetic material-containing layer is preferably not less than approximately 0.3 and not more than approximately 1.0, and is even more preferably not less than approximately 0.4 and not more than approximately 1.0.

Contraction of a recording paper may occur, for example, during fixing of an image formed using an electrophotographic method, or during drying of an ink that has been printed using an inkjet method, although this is not an exhaustive list.

Figure 4:
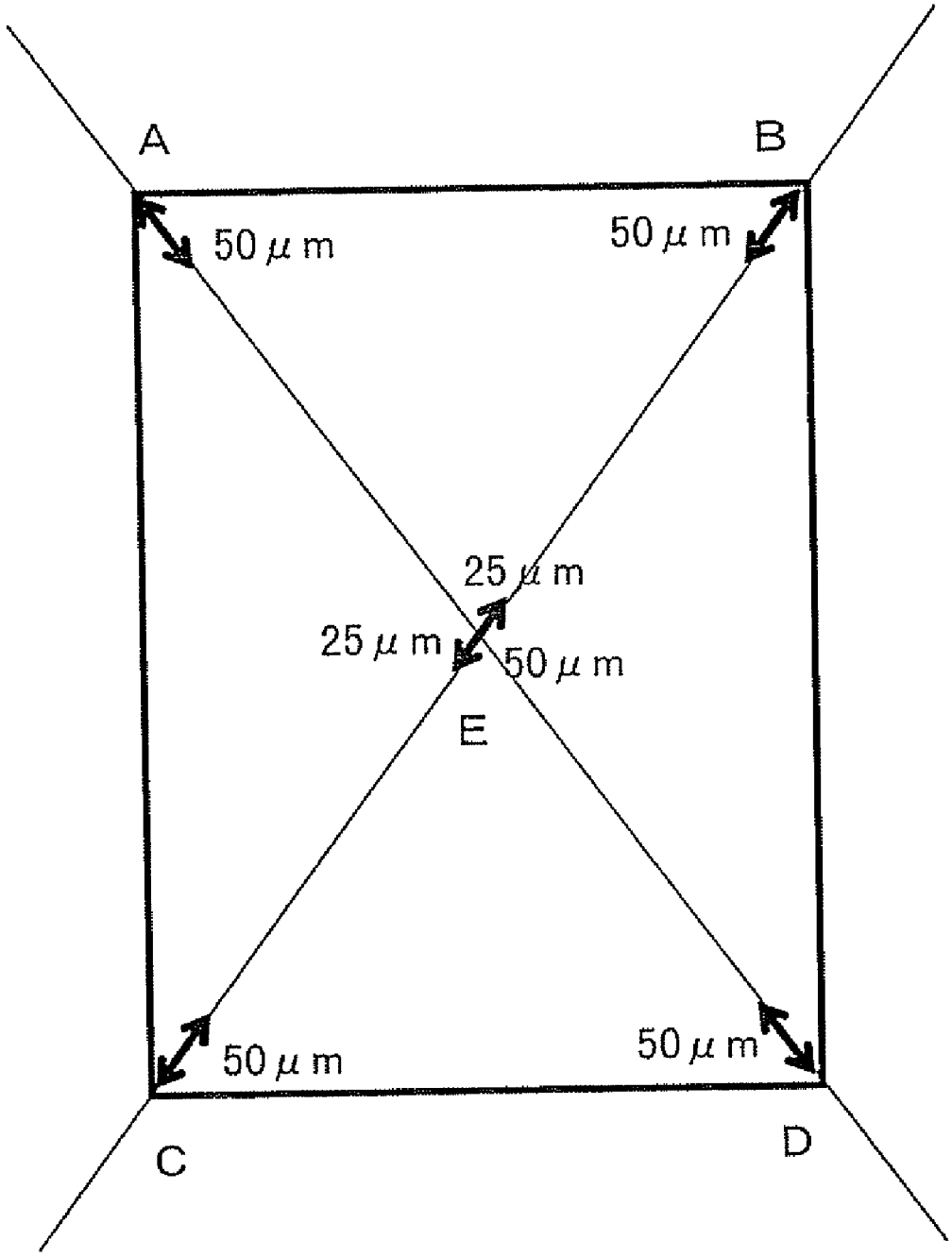
FIG. 4 is a diagram describing regions used for measuring the shape factor and particle size for a filler within a recording paper according to an exemplary embodiment of the present invention.

In this description, the shape factor describes the ratio between the minor axis and major axis of a particle (minor axis/major axis). The shape factor of the filler within the recording paper is measured from a scanning electron microscope image of a cross-section of the recording paper. Electron microscope images of cross-sections of the recording paper in the regions A to D with widths of approximately 50 μm shown in FIG. 4 (regions that extend approximately 50 μm along a diagonal line from each of the corners of the recording paper towards the center of the paper) and the region E (a region that extends approximately 25 μm in each direction (namely, a total of approximately 50 μm) along one diagonal from the center of the recording paper towards opposite corners of the paper) are analyzed using the image processing software "Image-Pro" (manufactured by Nippon Roper Co., Ltd.), and the average value of the shape factor is calculated for each of the regions. The value quoted for the "shape factor" of the filler in the present invention refers to the value obtained by ignoring the region in which the average value for the shape factor is largest and the region in which the average value for the shape factor is smallest, and calculating the average of the shape factors for the remaining three regions.

The filler 16 within the recording paper according to an exemplary embodiment contains particles for which the particle size is preferably not less than approximately 0.1 μm and not more than approximately 50 μm, even more preferably not less than approximately 0.5 μm and not more than approximately 40 μm, and most preferably not less than approximately 1 μm and not more than approximately 30 μm.

Figure 5:
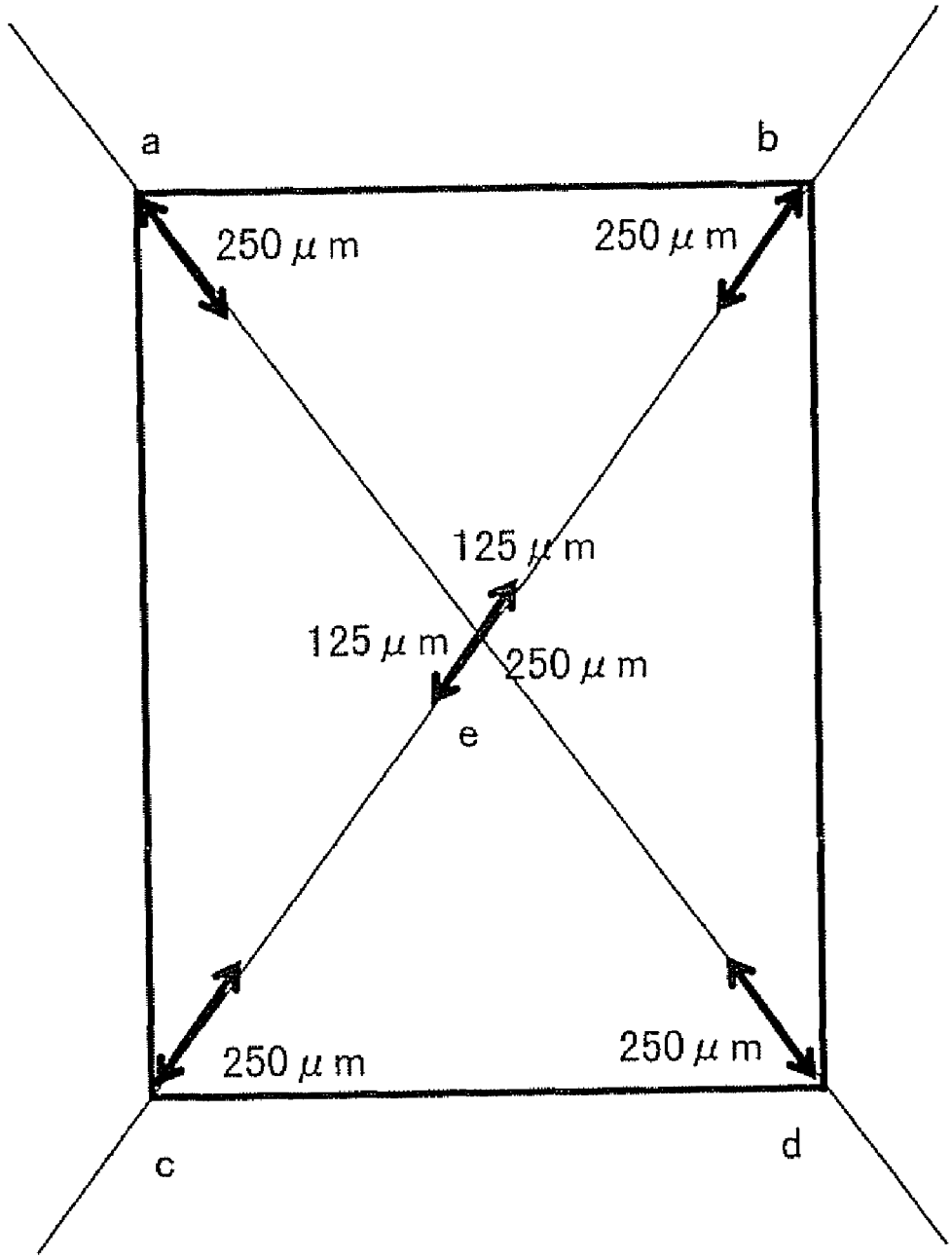
FIG. 5 is a diagram describing regions used for measuring the proportion of a filler within the magnetic material-containing layer of a recording paper according to an exemplary embodiment of the present invention.

In this description, the blend quantity of the filler relative to the pulp within the recording paper refers to the value measured in accordance with JIS P 8251. Furthermore, the proportion of the total quantity of filler that is contained within the magnetic material-containing layer is measured by elemental composition analysis using SEM-EDX (S-3400N, manufactured by Hitachi, Ltd.). Conditions for this observation include using a secondary electron image, with an accelerating voltage of approximately 20 kV, a magnification of approximately 500×, and a working distance of approximately 10 mm, whereas the regions observed are 5 regions with widths of approximately 250 μm shown in FIG. 5, namely, cross-sections of the recording paper labeled regions a to d (regions that extend approximately 250 μm along a diagonal line from each of the corners of the recording paper towards the center of the paper), and a region e (a region that extends approximately 125 μm in each direction (namely, a total of approximately 250 μm) along one diagonal from the center of the recording paper towards opposite corners of the paper). The proportion of the filler within the magnetic material-containing layer is determined for each of these regions, and the value quoted for the "proportion of the filler within the magnetic material-containing layer" in the present invention refers to the value obtained by ignoring the region in which this proportion is largest and the region in which the proportion is smallest, and calculating the average of the proportions for the remaining three regions.

The particle size of the filler 16 within the recording paper is measured from a scanning electron microscope image of a cross-section of the recording paper. Electron microscope images of cross-sections of the recording paper in the regions A to D with widths of approximately 50 μm shown in FIG. 4 (regions that extend approximately 50 μm along a diagonal line from each of the corners of the recording paper towards the center of the paper) and the region E (a region that extends approximately 25 μm in each direction (namely, a total of approximately 50 μm) along one diagonal from the center of the recording paper towards opposite corners of the paper) are analyzed using the image processing software "Image-Pro" (manufactured by Nippon Roper Co., Ltd.), and the average value for the particle size is calculated for each of the regions. The value quoted for the "particle size" in the present invention refers to the value obtained by ignoring the region in which the average value for the particle size is largest and the region in which the average value for the particle size is smallest, and calculating the average of the particle sizes for the remaining three regions.

The shape of the magnetic material 14 within the recording paper according to an exemplary embodiment of the invention is preferably a long (linear) shape, a wire-like or belt-like shape is even more desirable, and a wire-like shape is the most preferred.

In those cases where the magnetic material 14 is a wire-shaped material, the diameter of the wire is preferably not less than approximately 10 μm and not more than approximately 90 μm, and is even more preferably not less than approximately 10 μm and not more than approximately 80 μm.

Furthermore, the length of the magnetic material 14 is preferably not less than approximately 10 mm. Moreover, the maximum length of the magnetic material 14 is preferably not more than approximately 350 mm, and is even more preferably not more than approximately 300 mm.

The diameter and length of the magnetic material 14 represent average values for all of the magnetic material 14 incorporated within the magnetic material 14. The diameter of the magnetic material 14 within the recording paper can be measured by physically removing the magnetic material from a cross-section of the recording paper or the interior of the recording paper, and then measuring the diameter using an optical microscope or electron microscope or the like. Furthermore, the length of the magnetic material 14 can be measured by physically removing the magnetic material from the surface of the recording paper or the interior of the recording paper, and then measuring the length using an optical microscope or electron microscope or the like.

The surface resistivity of the recording paper according to an exemplary embodiment is preferably adjusted to a value not less than approximately $1\times10^{9}$ Ω/square and not more than approximately $5\times10^{11}$ Ω/square, whereas the volume resistivity is preferably adjusted to a value not less than approximately $1\times10^{10}$Ω·cm and not more than approximately $1\times10^{14}$ Ω·cm.

In those cases where an image is formed by an electrophotographic method, even if the surface of the magnetic material is not coated with an insulating layer or the like containing a resin or a metal oxide or the like, localized transfer faults in the vicinity of those regions where the magnetic material exists within the recording paper may be unlikely. A resistance controller such as those described above can be used for regulating the resistance.

There are no particular restrictions on the grammage (JIS P-8214) of the recording paper according to an exemplary embodiment of the invention, although a value of not less than approximately 60 g/m$^2$ is preferred.

Moreover, the paper moisture content when the recording paper according to an exemplary embodiment is subjected to humidity conditioning for not less than approximately 12 hours in an atmosphere at 23° C. and 50% RH is preferably not less than approximately 4.0% by mass and not more than approximately 7.0% by mass, and is even more preferably not less than approximately 4.5% by mass and not more than approximately 7.0% by mass. This ensures that, compared with those cases where the moisture content is less than approximately 4.0% by mass or greater than approximately 7.0% by mass, the image quality may be more favorable when the image is output using an electrophotographic method.

In the recording paper according to an exemplary embodiment of the invention, if the total thickness of the recording sheet is deemed to be 1, then the magnetic material-containing layer preferably has a thickness within a range from approximately 0.2 to approximately 0.8, and even more preferably within a range from approximately 0.2 to approximately 0.5.

EXAMPLES

As follows is a more detailed description of the present invention based on a series of examples and comparative examples, although the present invention is in no way limited by the examples presented below.

Preparation of Recording Papers

Example 1

To a pulp slurry containing 100 parts by mass of LBKP (hardwood bleached kraft pulp) are added, relative to the 100 parts by mass of the pulp, 0.13 parts of cationized starch (product name: MS4600, manufactured by Nihon Shokuhin Kako Co., Ltd.), 0.04 parts by mass of alkenyl succinic anhydride (Fibran 81, manufactured by Oji National Co., Ltd.), and 10 parts by mass of rod-shaped calcium carbonate (HPC-R8, manufactured by Hokkaido Cooperation Lime Corporation). The resulting mixture is diluted with white water, yielding a paper stock slurry A.

Using the paper stock slurry A obtained in this manner (solid fraction concentration: 1.0% by mass), an oriented sheet-former (manufactured by Kumagai Riki Kogyo Co., Ltd.) is used to conduct papermaking under the conditions described below, yielding sheets A and B.

[Papermaking Conditions]

Drum rotation rate: 1,000 revolutions/min.

Paper stock ejection pressure: $9.807\times10^{4}$ Pa (1.0 kgf/cm$^2$)

Stroke repetitions: 5

Subsequently, to a pulp slurry containing 100 parts by mass of LBKP (hardwood bleached kraft pulp) are added, relative to the 100 parts by mass of the pulp, 0.13 parts of cationized starch (product name: MS4600, manufactured by Nihon Shokuhin Kako Co., Ltd.) and 0.04 parts by mass of alkenyl succinic anhydride (Fibran 81, manufactured by Oji National Co., Ltd.), and then 5 parts by mass and 25 parts by mass respectively of a magnetic material (composition: Fe—Si—B, diameter: 50 μm, length: 50 mm) and a rod-shaped calcium carbonate filler (HPC-R8, manufactured by Hokkaido Cooperation Lime Corporation) are added relative to the 100 parts by mass of the pulp. The resulting mixture is diluted with white water, yielding a paper stock slurry B.

Using the paper stock slurry B obtained in this manner (solid fraction concentration: 1.0% by mass), an oriented sheet-former (manufactured by Kumagai Riki Kogyo Co., Ltd.) is used to conduct papermaking under the conditions described below, yielding a sheet C.

[Papermaking Conditions]

Drum rotation rate: 1,000 revolutions/min.

Paper stock ejection pressure: $9.807\times10^{4}$ Pa (1.0 kgf/cm$^2$)

Stroke repetitions: 5

The three prepared sheets are arranged with the sheet C sandwiched as an intermediate layer between the sheets A and B, a square sheet machine press (manufactured by Kumagai Riki Kogyo Co., Ltd.) is used to press the sheets for one minute under a pressure of $9.807\times10^5$ Pa (10 kgf/cm$^2$), and drying is then conducted at a heating temperature of 100° C. and a rotational speed of 100 cm/minute using a KRK rotary drier (manufactured by Kumagai Riki Kogyo Co., Ltd.), yielding a recording paper with a grammage of 101 g/m$^2$.

The proportion of the filler contained within the magnetic material-containing layer is measured by observing the Ca blend ratio via elemental composition analysis using SEM-EDX. The thickness values for the recording paper and the magnetic material-containing layer are measured using Scanning Electron Microscope (SEM) VE-7800 (manufactured by KEYENCE). Details of the paper properties are shown in Table 1.

Example 2

With the exception of replacing the rod-like calcium carbonate used in the example 1 with a light calcium carbonate (Light Calcium Carbonate, manufactured by Hayashi-Kasei Co., Ltd.), preparation is conducted in the same manner as the example 1, yielding a recording paper with a grammage of 100 g/m$^2$.

Example 3

With the exception of replacing the rod-like calcium carbonate used in the example 1 with a light calcium carbonate (Neolight SP-300, manufactured by Takehara Kagaku Kogyo Co., Ltd.), preparation is conducted in the same manner as the example 1, yielding a recording paper with a grammage of 102 g/m$^2$.

Example 4

With the exceptions of replacing the rod-like calcium carbonate used in the example 1 with a light calcium carbonate (Neolight SS, manufactured by Takehara Kagaku Kogyo Co., Ltd.), setting the blend quantity of the light calcium carbonate used in preparing the paper stock slurry A to 7 parts by mass, and setting the blend quantity of the light calcium carbonate used in preparing the paper stock slurry B to 10 parts by mass, preparation is conducted in the same manner as the example 1, yielding a recording paper with a grammage of 102 g/m$^2$.

Example 5

With the exceptions of altering the blend quantity of the light calcium carbonate used in preparing the paper stock slurry A in the example 4 to 12 parts by mass, and altering the blend quantity of the light calcium carbonate used in preparing the paper stock slurry B to 30 parts by mass, preparation is conducted in the same manner as the example 4, yielding a recording paper with a grammage of 103 g/m$^2$.

Example 6

With the exceptions of altering the blend quantity of the light calcium carbonate used in preparing the paper stock slurry A in the example 3 to 12 parts by mass, and altering the blend quantity of the light calcium carbonate used in preparing the paper stock slurry B to 45 parts by mass, preparation is conducted in the same manner as the example 3, yielding a recording paper with a grammage of 104 g/m$^2$.

Example 7

The rod-like calcium carbonate used in the paper stock slurry A prepared in the example 1 is replaced with 4 parts by mass of asilica gel (Mizukasil P-78D, manufactured by Mizusawa Industrial Chemicals, Ltd.), and a paper stock slurry A' is prepared. Using the paper stock slurry A' obtained in this manner (solid fraction concentration: 1.2% by mass), an oriented sheet-former (manufactured by Kumagai Riki Kogyo Co., Ltd.) is used to conduct papermaking under the conditions described below, yielding sheets A' and B'.

[Papermaking Conditions]

Drum rotation rate: 1,000 revolutions/min.

Paper stock ejection pressure: $9.807\times10^4$ Pa (1.0 kgf/cm$^2$)

Stroke repetitions: 7

Subsequently, a magnetic material (composition: Fe—Si—B, diameter: 20 μm, length: 340 mm) is placed on the surface of the sheet A', a silica gel (Mizukasil P-78D, manufactured by Mizusawa Industrial Chemicals, Ltd. ) is dispensed nearly uniformly across the surface of the sheet A' in sufficient quantity to provide 30 parts by mass of the silica gel per 100 parts by mass of the pulp within the paper stock slurry A', and the sheet B' is then overlaid on the surface of the sheet A'. Subsequently, a square sheet machine press (manufactured by Kumagai Riki Kogyo Co., Ltd.) is used to press the sheets for one minute under a pressure of $9.807\times10^5$ Pa (10 kgf/cm$^2$), and drying is then conducted at a heating temperature of 100° C. and a rotational speed of 100 cm/minute using a KRK rotary drier (manufactured by Kumagai Riki Kogyo Ca., Ltd.), yielding a paper with a grammage of 100 g/m$^2$. The proportion of the filler contained within the magnetic material-containing layer is measured by observing the Si blend ratio via elemental composition analysis using SEM-EDX. Details of the paper properties are shown in Table 1.

Example 8

With the exception of changing the magnetic material used in the example 7 to a magnetic material with a composition of Fe—Si—B (diameter: 85 μm, length: 15 mm), preparation is conducted in the same manner as the example 7, yielding a recording paper with a grammage of 102 g/m$^2$.

Comparative Example 1

With the exceptions of altering the blend quantity of the filler within the paper stock slurry A prepared in the example 1 to 20 parts by mass, and altering the blend quantity of the filler within the paper stock slurry B to 0 parts by mass, preparation is conducted in the same manner as the example 1, yielding a recording paper with a grammage of 103 g/m$^2$. Details of the paper properties are shown in Table 1.

Comparative Example 2

Following the procedure of the example 7, but with the exception of altering the blend quantity of the filler within the paper stock slurry A' to 20 parts by mass, the magnetic material is placed on the surface of the sheet A' without dispensing the filler, and the sheet B' is then overlaid on top. Subsequently, a square sheet machine press (manufactured by Kumagai Riki Kogyo Co., Ltd.) is used to press the sheets for one minute under a pressure of $9.807\times10^5$ Pa (10 kgf/cm$^2$), and drying is then conducted at a heating temperature of 100° C. and a rotational speed of 100 cm/minute using a KRK rotary drier (manufactured by Kumagai Riki Kogyo Co., Ltd.), yielding a recording paper with a grammage of 102 g/m$^2$. Details of the paper properties are shown in Table 1.

<Evaluation>

In order to evaluate the presence detection precision for a recording paper, a detection gate (manufactured by Unipulse Corp., a magnetic wire-based product observation system, product name: SAS) shown in FIGS. 6A-6C are used to measure the pulse signal arising from the magnetic material contained within the paper.

The detection gate used for this evaluation contains a pair of opposing detectors equipped with an excitation coil that generates an alternating magnetic field, and a detection coil that detects magnetization reversal of the magnetic wire within the paper 100. FIGS. 6A-6C represent a series of schematic illustrations showing the structure of the detection gate used for evaluating the examples, wherein FIG. 6A is a front view of the detection gate, FIG. 6B is a side view of one of the detectors within the detection gate, viewed from a side surface (namely, viewed from the direction of the arrow X shown in FIG. 6A), and FIG. 6C is a top view of one of the detectors within the detection gate, viewed from a above (namely, viewed from the direction of the arrow Y shown in FIG. 6A). In the figures, numeral 100 represents a sheet of (A4 size) paper, 300 represents the detection gate, 302 represents a first detector, 304 represents a second detector, and 400 represents a floor surface, whereas the letter H represents the height from the floor surface 400 to the paper 100, and the letter E represents the distance from the side edge (of the long side) of the first detector 302 to the central point across the short side of the paper 100.

Figure 6A:
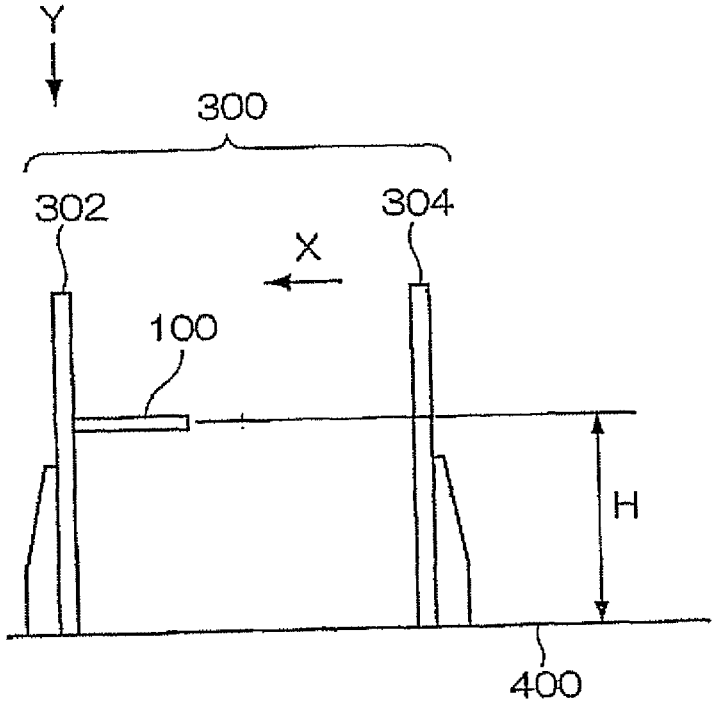
FIGS. 6A, 6B and 6C are schematic illustrations showing the structure of a detection gate used for evaluating the presence detection precision for recording papers in examples of the present invention.
Figure 6B:
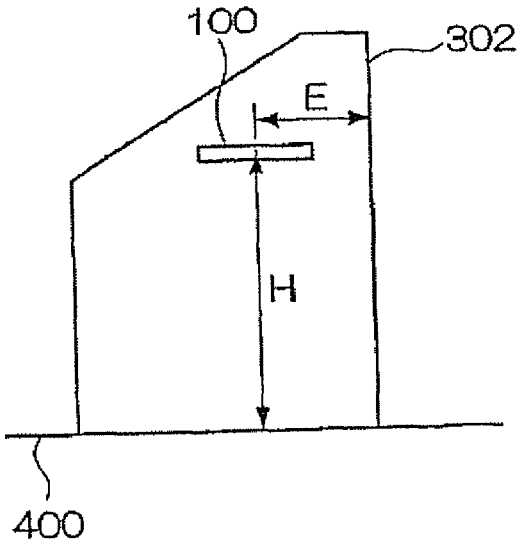
Figure 6C:
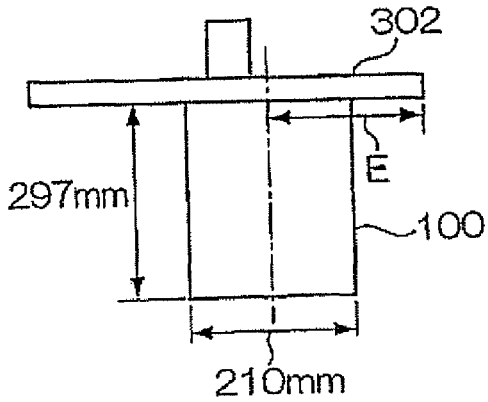

As shown in FIGS. 6A-6C, the detection gate 300 includes the first detector 302 and the second detector 304 in opposing positions on top of the floor surface 400, wherein the first detector 302 and the second detector 304 have the same structure, with a height of approximately 1.5 m. Furthermore, the distance between the two detectors 302 and 304 is approximately 0.9 m. Measurement of the pulse signal is conducted under an atmosphere at 23° C. and 30% RH, with the paper 100 arranged parallel to the floor surface 400 as shown in FIGS. 6A-6C, and is performed with one of the short edges of the paper 100 in stationary contact with the side of the first detector 302 that is positioned facing the second detector 304. The height H from the floor surface 400 to the paper 100 is set to 1,250 mm, and the distance E from the side edge of the first detector 302 to the central point across the short side of the paper 100 is set to 200 mm. Furthermore, during measurement, the maximum strength for the alternating magnetic field within the plane of the first detector 302 in contact with the paper 100, at a position at a height H from the floor surface and a distance E from the side edge of the first detector 302, is set to a value of 9.2 Oe.

The pulse signal detected by the detection gate 300 is read into a digital oscilloscope (DL1540, manufactured by Yokogawa Electric Corporation), and the voltage of the peak value for the pulse is recorded as the pulse value.

For each of the recording papers prepared in the examples and comparative examples, the pulse value of the recording paper prior to fixing (the initial pulse value), and the pulse value following formation of an image using an image forming apparatus (the post-fixing pulse value) are measured. Here, the initial pulse value is measured using a recording paper that has not yet been subjected to the image formation test, but which has been subjected to humidity conditioning for not less than 12 hours in an atmosphere at 23° C. and 50% RH.

Furthermore, the post-fixing pulse value is measured by taking a recording paper that has not yet been subjected to the image formation test, but which has been subjected to humidity conditioning for not less than 12 hours in an atmosphere at 23° C. and 50% RH, conducting double-sided printing of a blank image onto the paper using an image forming apparatus (DocuCentre Color f450, manufactured by Fuji Xerox Co., Ltd.) set to normal paper A mode and full color mode, and following completion of the double-sided printing, transporting the recording paper to the detection gate 300 and positioning the paper as shown in FIGS. 6A-6C. Here, the post-fixing pulse value refers to the pulse value measured 30 seconds after the point where the double-sided printing of the recording paper is complete and the paper is ejected from the image forming apparatus (immediately following the second fixing operation).

Using the initial pulse value and the post-fixing pulse value, the variation T (%) in the pulse value is determined based on the formula shown below. The results are shown in Table 1.

$$\text{Pulse variation } T = (\text{post-fixing pulse value}/\text{initial pulse value}) \times 100$$

The thus obtained pulse variation values T are evaluated using the criteria shown below. The results are shown in Table 1.

G0: T=not less than 80, not more than 100

G1: T=not less than 50, less than 80

G2: T=not less than 30, less than 50

G3: T=less than 30

TABLE 1

| | Example 1 | Example 2 | Example 3 | Example 4 | Example 5 | Example 6 | Example 7 | Example 8 | Comparative Example 1 | Comparative Example 2 |
|---|---|---|---|---|---|---|---|---|---|---|
| Grammage (g/m$^2$) | 101 | 100 | 102 | 102 | 103 | 104 | 100 | 102 | 103 | 102 |
| Paper thickness (μm) | 114 | 116 | 118 | 116 | 117 | 120 | 115 | 115 | 116 | 113 |
| Magnetic material-containing layer thickness/paper thickness | 0.44 | 0.43 | 0.42 | 0.43 | 0.43 | 0.42 | 0.17 | 0.74 | — | — |
| Filler | Rod-like calcium carbonate | Light calcium carbonate | Light calcium carbonate | Light calcium carbonate | Light calcium carbonate | Light calcium carbonate | Silica gel | Silica gel | Light calcium carbonate | Silica gel |
| Filler shape factor | 0.13 | 0.2 | 0.55 | 0.73 | 0.73 | 0.73 | 0.94 | 0.94 | 0.73 | 0.94 |
| Total filler within recording paper (mass % relative to pulp) | 11 | 12 | 12 | 6 | 18 | 26 | 11 | 10 | 10 | 11 |
| Proportion of filler in magnetic material-containing layer (%) | 65 | 63 | 62 | 45 | 53 | 77 | 88 | 87 | 0 | 0 |

TABLE 1-continued

| | | Example 1 | Example 2 | Example 3 | Example 4 | Example 5 | Example 6 | Example 7 | Example 8 | Comparative Example 1 | Comparative Example 2 |
|---|---|---|---|---|---|---|---|---|---|---|---|
| Paper layer structure | | 3-layer | 3-layer | 3-layer | 3-layer | 3-layer | 3-layer | 3-layer | 3-layer | 3-layer | 3-layer |
| Magnetic material-containing layer | | Pulp mix | Pulp mix | Pulp mix | Pulp mix | Pulp mix | Pulp mix | No pulp | No pulp | Pulp mix | No pulp |
| Magnetic material | Diameter (μm) | 50 | 50 | 50 | 50 | 50 | 50 | 20 | 85 | 50 | 20 |
| | Length (mm) | 50 | 50 | 50 | 50 | 50 | 50 | 340 | 15 | 50 | 340 |
| Evaluation | | G2 | G1 | G1 | G1 | G0 | G0 | G0 | G0 | G3 | G3 |

In this manner, the recording papers of the examples 1 to 8 are able to better suppress reductions in the output of the pulse signal generated by the large Barkhausen effect than the recording papers of the comparative examples 1 and 2.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording paper comprising (a) pulp layers containing a pulp, and (b) a magnetic material-containing layer comprised of a magnetic material that generates a large Barkhausen effect and a filler containing organic or inorganic particles, the magnetic material-containing layer being disposed between the pulp layers, wherein:

the recording paper contains not less than approximately 3% by mass and not more than approximately 30% by mass of the filler relative to the pulp within the recording paper; and an amount of the filler contained within the magnetic material-containing layer is not less than approximately 50% and not more than approximately 90% of an entirety of the filler within the recording paper.

2. The recording paper according to claim 1, wherein if a total thickness of the recording paper is 1, then the magnetic material-containing layer has a thickness within a range from approximately 0.2 to approximately 0.8.

3. The recording paper according to claim 2, wherein if a total thickness of the recording paper is 1, then the magnetic material-containing layer has a thickness within a range from approximately 0.2 to approximately 0.5.

4. The recording paper according to claim 1, wherein the filler is selected from the group consisting of calcium carbonate-based fillers, light calcium carbonate and chalk, silicates, baked clay, pyrophyllite, sericite and talc, titanium dioxide, calcium sulfate, barium sulfate, zinc oxide, zinc sulfide, zinc carbonate, aluminum silicate, calcium silicate, magnesium silicate, synthetic silica, aluminum hydroxide, alumina, white carbon, saponite, dolomite, calcium montmorillonite, sodium montmorillonite, bentonite, polymethylmethacrylate particles, acrylic plastic pigments, polyolefin resin particles, chitosan particles, cellulose particles, polyamino acid particles, and styrene.

5. A recording paper comprising (a) pulp layers containing a pulp, and (b) a magnetic material-containing layer comprised of a magnetic material that generates a large Barkhausen effect and a filler containing organic or inorganic particles, the magnetic material-containing layer being disposed between the pulp layers, wherein:

the recording paper contains not less than approximately 3% by mass and not more than approximately 30% by mass of the filler relative to the pulp within the recording paper;

an amount of the filler contained within the magnetic material-containing layer is not less than approximately 50% and not more than approximately 90% of an entirety of the filler within the recording paper; and a shape factor of the filler within the magnetic material-containing layer is not less than approximately 0.2 and not more than approximately 1.0.

6. The recording paper according to claim 5, wherein the filler is selected from the group consisting of calcium carbonate-based fillers, light calcium carbonate and chalk, silicates, baked clay, pyrophyllite, sericite and talc, titanium dioxide, calcium sulfate, barium sulfate, zinc oxide, zinc sulfide, zinc carbonate, aluminum silicate, calcium silicate, magnesium silicate, synthetic silica, aluminum hydroxide, alumina, white carbon, saponite, dolomite, calcium montmorillonite, sodium montmorillonite, bentonite, polymethylmethacrylate particles, acrylic plastic pigments, polyolefin resin particles, chitosan particles, cellulose particles, polyamino acid particles, and styrene.

7. The recording paper according to claim 5, wherein the shape factor is a measure of a ratio between the minor axis and major axis of the particles.

8. A recording paper comprising (a) pulp layers containing a pulp, and (b) a magnetic material-containing layer comprised of a magnetic material that generates a large Barkhausen effect and a filler containing organic or inorganic particles, the magnetic material-containing layer being disposed between the pulp layers, wherein:

the recording paper contains not less than approximately 3% by mass and not more than approximately 30% by mass of the filler relative to the pulp within the recording paper;

an amount of the filler contained within the magnetic material-containing layer is not less than approximately 50% and not more than approximately 90% of an entirety of the filler within the recording paper; and a shape factor of the filler within the magnetic material-containing layer is not less than approximately 0.4 and not more than approximately 1.0.

9. The recording paper according to claim 8, wherein the filler is selected from the group consisting of calcium carbonate-based fillers, light calcium carbonate and chalk, silicates, baked clay, pyrophyllite, sericite and talc, titanium dioxide, calcium sulfate, barium sulfate, zinc oxide, zinc sulfide, zinc carbonate, aluminum silicate, calcium silicate, magnesium silicate, synthetic silica, aluminum hydroxide, alumina, white carbon, saponite, dolomite, calcium montmorillonite, sodium montmorillonite, bentonite, polymethylmethacrylate particles, acrylic plastic pigments, polyolefin resin particles, chitosan particles, cellulose particles, polyamino acid particles, and styrene.

10. The recording paper according to claim 8, wherein the shape factor is a measure of a ratio between the minor axis and major axis of the particles.

* * * * *